US010220615B2

(12) United States Patent
Sakamoto

(10) Patent No.: US 10,220,615 B2
(45) Date of Patent: Mar. 5, 2019

(54) METHOD FOR CONTROLLING LIQUID EJECTING APPARATUS AND LIQUID EJECTING APPARATUS

(71) Applicant: SEIKO EPSON CORPORATION, Tokyo (JP)

(72) Inventor: Ryota Sakamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/909,531

(22) Filed: Mar. 1, 2018

(65) Prior Publication Data

US 2018/0250931 A1 Sep. 6, 2018

(30) Foreign Application Priority Data

Mar. 6, 2017 (JP) ..... 2017-041482

(51) Int. Cl.
*B41J 2/14* (2006.01)
*B41J 2/045* (2006.01)

(52) U.S. Cl.
CPC ..... *B41J 2/04581* (2013.01); *B41J 2/04588* (2013.01); *B41J 2/04596* (2013.01); *B41J 2/14233* (2013.01); *B41J 2202/11* (2013.01)

(58) Field of Classification Search
CPC ..... B41J 2/04581; B41J 2/04596
See application file for complete search history.

(56) References Cited

U.S. PATENT DOCUMENTS 5,541,628 A 7/1996 Chang
5,856,834 A 1/1999 Murphy
6,386,664 B1 5/2002 Hosono
6,709,091 B1 3/2004 Takahashi
6,742,859 B2 6/2004 Yonekubo
2001/0003349 A1 6/2001 Hosono
2001/0050696 A1 12/2001 Suzuki et al.
2002/0012017 A1 1/2002 Yonekubo
2002/0140752 A1 10/2002 Pulman
2003/0103096 A1 6/2003 Sayama
2003/0146947 A1 8/2003 Ozaki
(Continued)

FOREIGN PATENT DOCUMENTS

CN 102756554 A 10/2012
EP 1950039 7/2008
(Continued)

OTHER PUBLICATIONS

Extended European Search Report for Application No. EP17159269 dated Aug. 15, 2017 (8 pages).
(Continued)

*Primary Examiner* — Julian D Huffman
(74) *Attorney, Agent, or Firm* — Workman Nydegger

(57) ABSTRACT

A method for controlling a liquid ejecting apparatus includes: driving a ejecting section by using each of a plurality of candidate waveforms of a minute vibration pulses in parallel with movement of a liquid ejecting head, the minute vibration pulses vibrates a liquid surface within a nozzle of the liquid ejecting head without causing liquid to be ejected from the nozzle, the candidate waveforms are different from each other; and setting a waveform of the minute vibration pulses included in a driving signal generated by the signal generating section, in accordance with an instruction accepted with an operating device.

11 Claims, 9 Drawing Sheets

(56) References Cited

U.S. PATENT DOCUMENTS

| | | | | |
|---|---|---|---|---|
| 2004/0040614 | A1 | 3/2004 | Sesek et al. | |
| 2005/0261641 | A1 | 11/2005 | Warchol et al. | |
| 2005/0275682 | A1 | 12/2005 | Seshimo | |
| 2007/0057979 | A1 | 3/2007 | Gardner et al. | |
| 2007/0176952 | A1* | 8/2007 | Sekiguchi | B41J 2/04551 347/11 |
| 2009/0231372 | A1 | 9/2009 | Shibata | |
| 2009/0289976 | A1 | 11/2009 | Nishimura | |
| 2012/0274689 | A1 | 11/2012 | Zhang | |
| 2015/0217564 | A1* | 8/2015 | Koerner | B41J 2/04525 347/10 |
| 2017/0253030 | A1* | 9/2017 | Kumagai | B41J 2/04551 |
| 2018/0086081 | A1 | 3/2018 | Sakamoto | |

FOREIGN PATENT DOCUMENTS

| | | | |
|---|---|---|---|
| JP | 2005-280199 | A | 10/2005 |
| JP | 2009090533 | | 4/2009 |
| JP | 2009279816 | | 12/2009 |
| JP | 2017-154415 | A | 9/2017 |
| JP | 2018-051812 | A | 4/2018 |

OTHER PUBLICATIONS

U.S. Appl. No. 15/703,181, Feb. 23, 2018, Office Action.
U.S. Appl. No. 15/441,835, Apr. 5, 2018, Office Action.
U.S. Appl. No. 15/441,835, Oct. 4, 2017, Office Action.
U.S. Appl. No. 15/703,181, filed Sep. 13, 2017, Sakamoto.
Office Action issued in U.S. Appl. No. 15/703,181 dated Dec. 19, 2018.

* cited by examiner

METHOD FOR CONTROLLING LIQUID EJECTING APPARATUS AND LIQUID EJECTING APPARATUS

BACKGROUND

1. Technical Field

The present invention relates to techniques for ejecting liquid such as ink.

2. Related Art

To date, liquid ejecting apparatuses that eject liquid from nozzles have been proposed. JP-A-2005-280199 discloses a configuration in which, for nozzles that do not eject liquid out of a plurality of nozzles, vibrations (hereinafter referred to as minute vibrations) are applied to the liquid surfaces within the nozzles such that the liquid is not ejected. The liquid is agitated by the minute vibrations and, as a result, an increase in viscosity of liquid in the vicinity of the nozzles may be reduced. Supplying pulses of a predetermined waveform (hereinafter referred to as minute vibration pulses) to a driving element, such as a piezoelectric element, generates minute vibrations.

The waveform of minute vibration pulses is set in advance based on the characteristics of standard liquid assumed to be used in a liquid ejecting apparatus (for example, genuine ink provided by the manufacturer of the liquid ejecting apparatus). However, in situations where a liquid ejecting apparatus is actually used, liquid other than the standard liquid (for example, non-genuine ink provided by a person other than the manufacturer of the liquid ejecting apparatus) is used in some cases. The waveform of minute vibration pulses is not necessarily suitable for liquid other than the standard liquid.

For example, when liquid whose viscosity is more likely to be increased than the viscosity of standard liquid is used, there is a possibility that minute vibrations caused by minute vibration pulses will not be able to sufficiently reduce an increase in viscosity of the liquid. When liquid whose viscosity is less likely to be increased than the viscosity of standard liquid is used, there is a possibility that ink will be ejected (an ejection error) by supply of minute vibration pulses to a driving element.

SUMMARY

In view of the circumstance described above, an advantage of some aspects of the invention is that the waveform of minute vibration pulses is suitably set in accordance with the characteristics of liquid used for a liquid ejecting apparatus.

A method for controlling a liquid ejecting apparatus according to a first aspect of the invention is a method for controlling a liquid ejecting apparatus that includes a liquid ejecting head including an ejecting section that ejects liquid from a nozzle, a transport body that moves the liquid ejecting head, a signal generating section that generates a driving signal, the driving signal including ejecting pulses that cause liquid to be ejected from the nozzle and minute vibration pulses that vibrate a liquid surface within the nozzle without causing liquid to be ejected from the nozzle, a driving section that drives the ejecting section by using the driving signal, and an operating device. The method includes controlling the driving section so as to cause, for each of a plurality of candidate waveforms different from each other, the minute vibration pulses of the candidate waveform to be supplied to the ejecting section in parallel with movement of the liquid ejecting head, and setting a waveform of minute vibration pulses included in a driving signal generated by the signal generating section, in accordance with an instruction from the operating device. According to the above first aspect, for each of a plurality of waveforms, the minute vibration pulses of the waveform are supplied to the ejecting section, and then the waveform of minute vibration pulses included in a driving signal is set in accordance with an instruction from the operating device. Accordingly, it is possible to suitably set the waveform of minute vibration pulses in accordance with the characteristics of ink used for the liquid ejecting apparatus.

In the first aspect of the invention, in the setting of a waveform of the minute vibration pulses, a candidate waveform selected by the operating device from among the plurality of waveforms may be set as a waveform of the minute vibration pulses. According to the above first aspect, an advantage is that it is possible to set suitable minute vibration pulses by a simple and easy operation of selecting any of a plurality of waveforms.

In the first aspect of the invention, the minute vibration pulses may include a plurality of intervals with different states of voltage change, and, in the setting of a waveform of the minute vibration pulses, at least either of an amplitude of the minute vibration pulses and a duration of each of the intervals may be set in accordance with an instruction from the operating device. According to the above first aspect, at least either of the amplitude of the minute vibration pulses and the duration of each of the intervals is set in accordance with an instruction from the user. Accordingly, it is possible to adjust the waveform of minute vibration pulses in detail.

In the first aspect of the invention, in the setting of a waveform of the minute vibration pulses, the waveform and the number of the minute vibration pulses included in one period of a driving signal generated by the signal generating section may be set in accordance with an instruction from the operating device. According to the above first aspect, since the waveform and the number of minute vibration pulses included in one period of a driving signal are changed in accordance with an instruction from the user, it is possible to suitably set the waveform of the minute vibration pulses in accordance with the characteristics of ink used for the liquid ejecting apparatus.

A method for controlling a liquid ejecting apparatus according to a second aspect of the invention is a method for controlling a liquid ejecting apparatus that includes a liquid ejecting head including an ejecting section that ejects liquid from a nozzle, a transport body that moves the liquid ejecting head, a signal generating section that generates a driving signal, the driving signal including ejecting pulses that cause liquid to be ejected from the nozzle and minute vibration pulses that vibrate a liquid surface within the nozzle without causing liquid to be ejected from the nozzle, and a driving section that drives the ejecting section by using the driving signal. The method includes controlling the driving section so as to cause, for each of a plurality of candidate waveforms different from each other, the minute vibration pulses of the candidate waveform to be supplied to the ejecting section in parallel with movement of the liquid ejecting head, and setting a waveform of minute vibration pulses included in a driving signal generated by the signal generating section to be, among the plurality of candidate waveforms, a candidate waveform with which an ejection error has not occurred when the minute vibration pulses have been supplied to the ejecting section. According to the above second aspect, for each of a plurality of waveforms, minute vibration pulses of the waveform are supplied to the ejecting section, and then a waveform of minute vibration pulses included in a driving signal is set to be, among the plurality of candidate waveforms, a candidate waveform with which an ejection error has not occurred when the minute vibration pulses have been supplied to the ejecting section. Accordingly, it is possible to suitably set the waveform of minute vibration pulses in accordance with the characteristics of ink used for the liquid ejecting apparatus.

In the first or second aspect of the invention, in the controlling of the driving section, for each of the plurality of candidate waveforms, the driving section may be controlled so as to cause ejecting pulses for forming a first pattern to be supplied to the ejecting section when the liquid ejecting head is at a specific position in a process of moving to a first side, ejecting pulses for forming a second pattern to be supplied to the ejecting section when the liquid ejecting head is at the specific position in a process of moving to a second side opposite to the first side, and, between forming the first pattern and forming the second pattern, the minute vibration pulses of the candidate waveform to be supplied to the ejecting section in parallel with movement of the liquid ejecting head. According to the above first or second aspect, minute vibration pulses are supplied to the ejecting section between forming the first pattern and forming the second pattern. Accordingly, it is possible to determine whether the intensity of minute vibrations is insufficient, depending on whether the first pattern and the second pattern are separate from each other. It is also possible to determine whether the intensity of minute vibrations is excessively large, depending on whether liquid lands on within a range where the liquid ejecting head moves.

In the first or second aspect of the invention, the waveform of minute vibration pulses included in a driving signal generated by the signal generating section may be set to be, among the plurality of candidate waveforms, a candidate waveform with which an amount of displacement between the first pattern and the second pattern falls within a threshold value and with which an ejection error has not occurred when the minute vibration pulses have been supplied to the ejecting section.

In the first or second aspect of the invention, prior to forming the first pattern and the second pattern, bidirectional adjustment for reducing a difference between a landing position of liquid in a process in which the liquid ejecting head moves to a first side and a landing position of liquid in a process in which the liquid ejecting head moves to a second side opposite to the first side may be performed. According to the above first or second aspect, prior to forming the first pattern and the second pattern, the error in the landing position for a reason other than minute vibrations is reduced. Accordingly, it is possible to set minute vibration pulses suitable for liquid actually used in the liquid ejecting apparatus.

A liquid ejecting apparatus according to a third aspect of the invention includes a liquid ejecting head including an ejecting section that ejects liquid from a nozzle, a transport body that moves the liquid ejecting head, a signal generating section that generates a driving signal, the driving signal including ejecting pulses that cause liquid to be ejected from the nozzle and minute vibration pulses that vibrate a liquid surface within the nozzle without causing liquid to be ejected from the nozzle, a driving section that drives the ejecting section by using the driving signal, an operating device, and a control processing section that, for each of a plurality of candidate waveforms different from each other, controls the driving section so as to cause the minute vibration pulses of the candidate waveform to be supplied to the ejecting section in parallel with movement of the liquid ejecting head, and sets a waveform of minute vibration pulses included in a driving signal generated by the signal generating section, in accordance with an instruction from the operating device. According to the above third aspect, for each of a plurality of waveforms, minute vibration pulses of the waveform are supplied to the ejecting section, and then the waveform of minute vibration pulses included in a driving signal is set in accordance with an instruction from the operating device. Accordingly, it is possible to suitably set the waveform of minute vibration pulses in accordance with the characteristics of ink used for the liquid ejecting apparatus.

A liquid ejecting apparatus according to a fourth aspect of the invention includes a liquid ejecting head including an ejecting section that ejects liquid from a nozzle, a transport body that moves the liquid ejecting head, a signal generating section that generates a driving signal, the driving signal including ejecting pulses that cause liquid to be ejected from the nozzle and minute vibration pulses that vibrate a liquid surface within the nozzle without causing liquid to be ejected from the nozzle, and a driving section that drives the ejecting section by using the driving signal, and a control processing section that, for each of a plurality of candidate waveforms different from each other, controls the driving section so as to cause the minute vibration pulses of the candidate waveform to be supplied to the ejecting section in parallel with movement of the liquid ejecting head, and sets a waveform of minute vibration pulses included in a driving signal generated by the signal generating section to be, among the plurality of candidate waveforms, a candidate waveform with which an ejection error has not occurred when the minute vibration pulses have been supplied. According to the above fourth aspect, for each of a plurality of waveforms, minute vibration pulses of the waveform are supplied to the ejecting section, and then the waveform of minute vibration pulses included in a driving signal is set to be, among the plurality of candidate waveforms, a candidate waveform with which an ejection error has not occurred when the minute vibration pulses have been supplied. Accordingly, it is possible to suitably set the waveform of minute vibration pulses in accordance with the characteristics of ink used for the liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
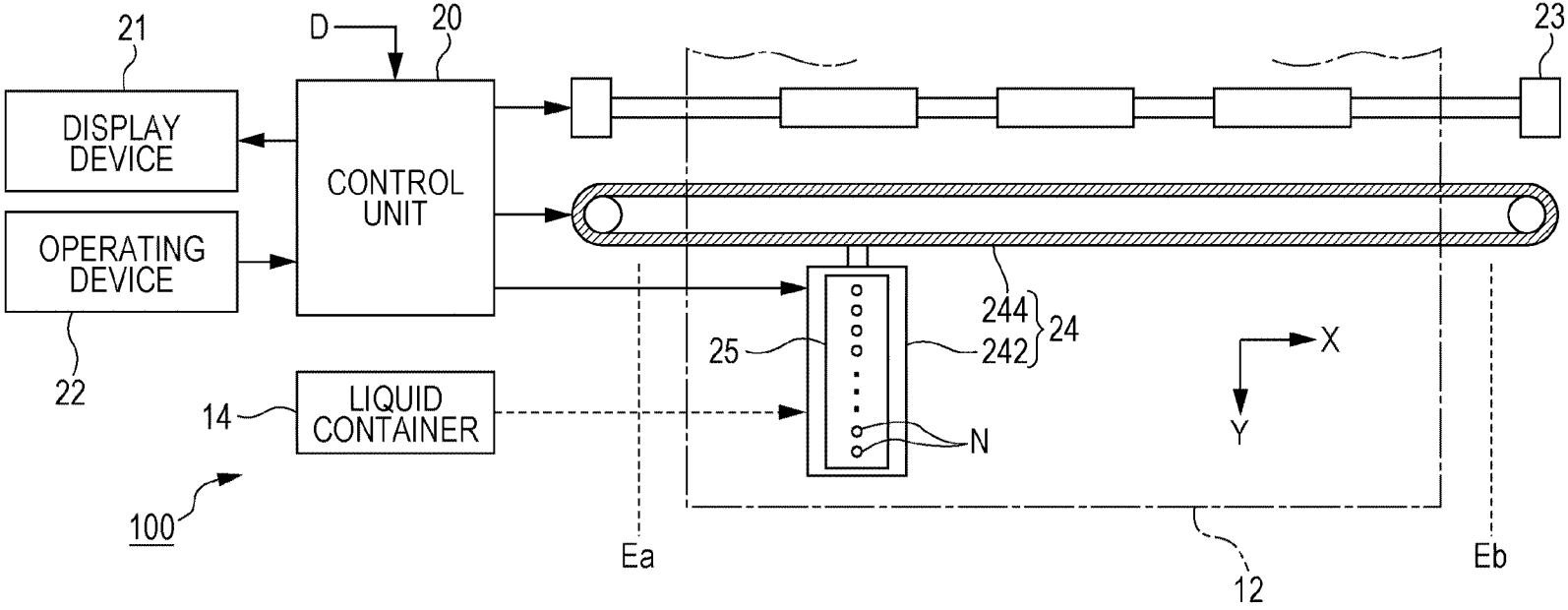
FIG. 1 is a configuration diagram for a liquid ejecting apparatus according to a first embodiment of the invention.

FIG. 1 is a diagram illustrating a configuration of a liquid ejecting apparatus 100 according to a first embodiment of the invention. The liquid ejecting apparatus 100 of the first embodiment is an ink jet printing apparatus that ejects ink, which is exemplary liquid, to a medium 12 (ejecting target). The medium 12 is typically printing paper; however, a printing target made of any material such as a resin film or a fabric may be used as the medium 12. As illustrated in FIG. 1, a liquid container 14 for storing ink is mounted in the liquid ejecting apparatus 100. For example, a cartridge attachable to or detachable from the liquid ejecting apparatus 100, a bag-like ink pack formed of a flexible film, or an ink tank capable of being replenished with ink is used as the liquid container 14.

As illustrated in FIG. 1, the liquid ejecting apparatus 100 includes a control unit 20, a display device 21, an operating device 22, a transport mechanism 23, a movement mechanism 24, and a liquid ejecting head 25. The control unit 20 is configured to include, for example, a control device, such as a central processing unit (CPU) or a field programmable gate array (FPGA), and a recording device, such as semiconductor memory (not illustrated), and entirely controls components of the liquid ejecting apparatus 100 when a program stored in a storage device is executed by the control device.

The display device 21 (for example, a liquid crystal display panel) displays an image specified by the control unit 20. The operating device 22 is an input device that accepts operations from the user. For example, an operation panel including a plurality of operation members to be pressed down by the user, or a touch panel that detects contact of the user with a display surface of the display device 21 is preferable as the operating device 22.

The transport mechanism 23 transports the medium 12 in the Y-direction under control of the control unit 20. For example, the transport mechanism 23 is configured to include a plurality of transport rollers. The movement mechanism 24 moves the liquid ejecting head 25 in the X-direction under control of the control unit 20. The X-direction is a direction crossing (typically orthogonal to) the Y-direction in which the medium 12 is transported. The movement mechanism 24 of the first embodiment includes an approximately box-shaped transport body 242 (carriage) for containing the liquid ejecting head 25 and a transport belt 244 to which the transport body 242 is fixed. The transport belt 244 is an endless belt built in the X-direction. Rotation of the transfer belt 244 under control of the control unit 20 causes the liquid ejecting head 25 to reciprocate together with the transport body 242 in the X-direction. Specifically, the liquid ejecting head 25 repeatedly moves back and forth within a range from a position Ea to a position Eb illustrated in FIG. 1. The position Ea is a standby position at which the liquid ejecting head 25 does not face the medium 12 (a home position corresponding to an end point of the reciprocation). Note that a configuration in which a plurality of liquid ejecting heads 25 are mounted on the transport body 242 and a configuration in which the liquid container 14 is mounted together with the liquid ejecting head 25 on the transport body 242 may be employed.

The liquid ejecting head 25 ejects ink supplied from the liquid container 14 from a plurality of nozzles N (ejecting holes) to the medium 12 under control of the control unit 20. The plurality of nozzles N are aligned in the Y-direction. The liquid ejecting head 25 ejects ink to the medium 12 in parallel with transportation of the medium 12 performed by the transport mechanism 23 and with repetitive reciprocation of the transport body 242, so that a desirable image is formed on the surface of the medium 12.

Figure 2:
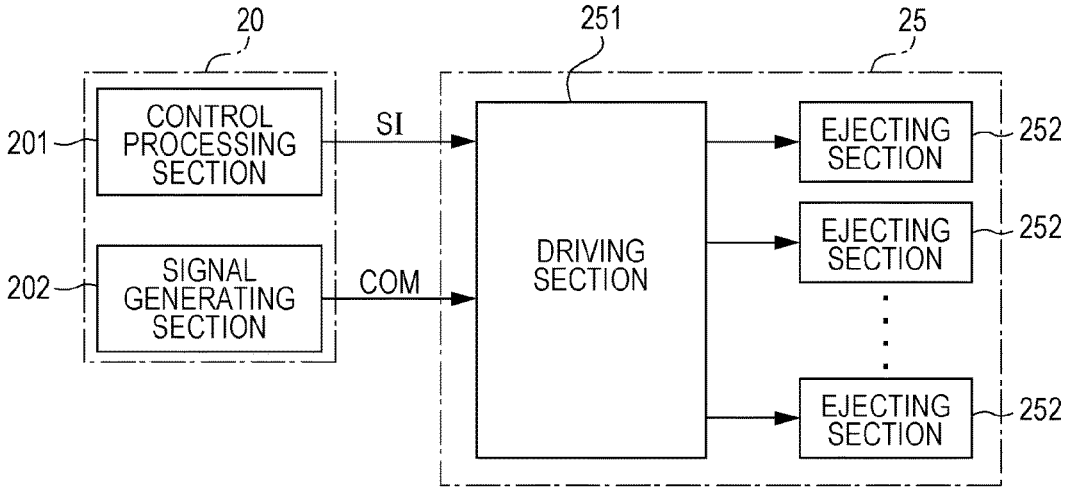
FIG. 2 is a configuration diagram focused on functions of the liquid ejecting apparatus.

FIG. 2 is a configuration diagram focused on functions of the liquid ejecting apparatus 100. The transport mechanism 23 and the movement mechanism 24 are not illustrated for the sake of convenience. As illustrated in FIG. 2, the control unit 20 of the first embodiment functions as a control processing section 201 and a signal generating section 202. The control processing section 201 controls operations in which the liquid ejecting head 25 ejects ink from each of the plurality of nozzles N. For example, the control processing section 201 generates a control signal SI that instructs each nozzle N whether or not to eject ink (ejection or non-ejection), and supplies the control signal SI to the liquid ejecting head 25. The control signal SI is generated in accordance with image data D supplied from an external device (for example, a host computer). The signal generating section 202 in FIG. 2 generates a driving signal COM. The driving signal COM is a signal used for ejection of ink performed by the liquid ejecting head 25.

Figure 3:
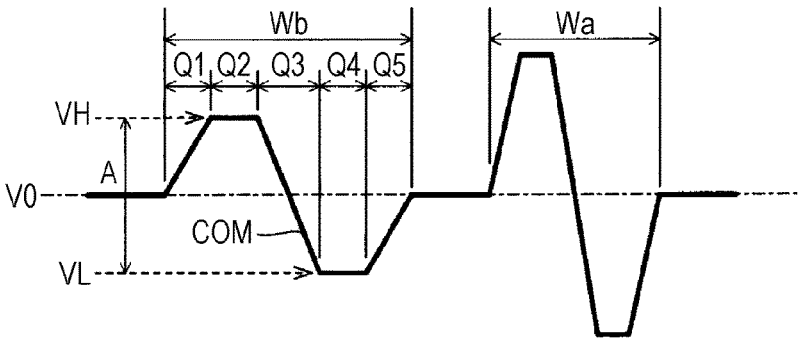
FIG. 3 is a waveform chart of a driving signal.

FIG. 3 is a diagram illustrating a waveform of the driving signal COM. As illustrated in FIG. 3, the driving signal COM in the first embodiment is a voltage signal including an ejecting pulse Wa and a minute vibration pulse Wb for each predetermined period. The ejecting pulse Wa is a pulse wave that causes ink to be ejected from the nozzles N. In contrast, the minute vibration pulse Wb is a pulse wave that vibrates the liquid surface (that is, meniscus) of ink within the nozzle N without ejecting ink from the nozzle N. Note that although the driving signal COM including one ejecting pulse Wa and one minute vibration pulse Wb is illustrated in FIG. 3 for the sake of convenience, the driving signal COM including two or more ejecting pulses Wa and two or more minute vibration pulses Wb may be used. In addition, the order of the ejecting pulse Wa and the minute vibration pulse Wb may be changed.

As illustrated in FIG. 3, the minute vibration pulse Wb includes a plurality of intervals Q (Q1 to Q5). The intervals Q are intervals on the time axis with different states (rise, fall, or maintain) of voltage change.

Specifically, the interval Q1 is an interval in which the voltage level rises with time from a predetermined reference voltage V0 to a high-potential voltage VH, and the interval Q2 is an interval in which the voltage level is maintained at the voltage VH. The interval Q3 is an interval in which the voltage level falls with time from the voltage VH to a voltage VL that is below the reference voltage V0, and the interval Q4 is an interval in which the voltage level is maintained at the voltage VL. The interval Q5 is an interval in which the voltage level rises with time from the voltage VL to the reference voltage V0. Note that the waveforms of the ejecting pulse Wa and the minute vibration pulse Wb are not limited to the waveforms illustrated in FIG. 3.

An amplitude A of the minute vibration pulse Wb is illustrated in FIG. 3. The amplitude A is a range in which the voltage level varies in the minute vibration pulse Wb, and corresponds to a difference between the high-potential voltage VH and the low-potential voltage VL. In the first embodiment, the amplitude A of the minute vibration pulse Wb may be changed in accordance with an instruction from the user to the operating device 22. The larger the amplitude A of the minute vibration pulse Wb, the more greatly the liquid surface of ink within the nozzle N vibrates.

As illustrated in FIG. 2, the liquid ejecting head 25 in the first embodiment includes a plurality of ejecting sections 252 corresponding to the nozzles N different from each other and a driving section 251 that drives each of the plurality of ejecting sections 252. Each of the plurality of ejecting sections 252 ejects ink in accordance with a signal (the ejecting pulse Wa or the minute vibration pulse Wb) supplied from the driving section 251. Note that the driving section 251 may be mounted outside the liquid ejecting head 25.

As illustrated in FIG. 2, a control signal SI generated by the control processing section 201 and the driving signal COM generated by the signal generating section 202 are supplied to the driving section 251. The driving section 251 in the first embodiment drives each of the plurality of ejecting sections 252 by using the driving signal COM in accordance with an instruction from the control processing section 201 (that is, the control signal SI). Specifically, the driving section 251 supplies the ejecting pulse Wa to the ejecting section 252 instructed to eject ink by the control signal SI and supplies the minute vibration pulse Wb to the ejecting section 252 instructed not to eject ink by the control signal SI. The ejecting section 252 to which the ejecting pulse Wa has been supplied ejects ink from the nozzle N and, in the ejecting section 252 to which the minute vibration pulse Wb has been supplied, minute vibrations are provided to the liquid surface (meniscus) within the nozzle N. Note that the driving section 251 may selectively supply a plurality of driving signals COM with different waveforms to the ejecting sections 252.

Figure 4:
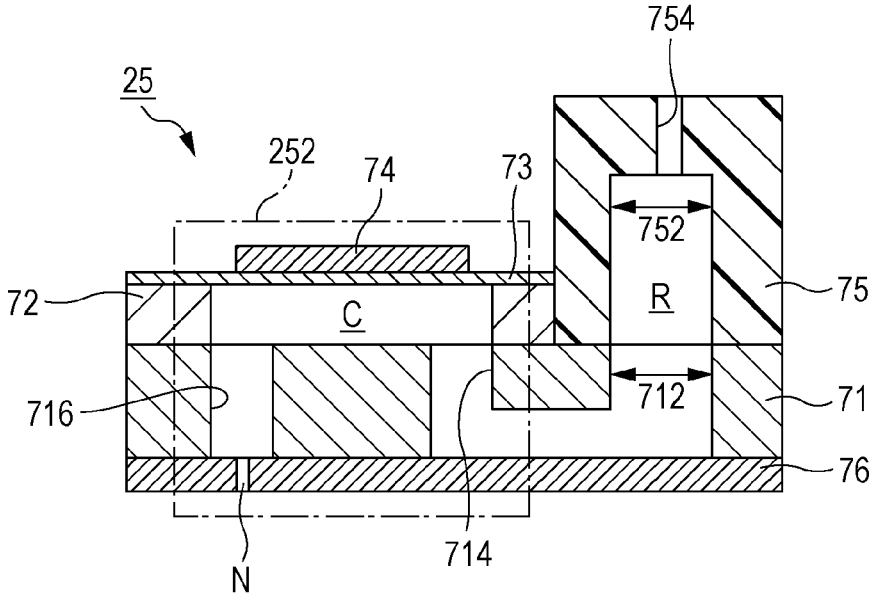
FIG. 4 is a sectional view of a liquid ejecting head.

FIG. 4 is a sectional view focused on any one ejecting section 252 of the liquid ejecting head 25. As illustrated in FIG. 4, the liquid ejecting head 25 is a structure in which a pressure chamber substrate 72, a vibration section 73, a piezoelectric element 74, and a support 75 are disposed on one side of a flow channel substrate 71, and a nozzle plate 76 is disposed on the other side. The flow channel substrate 71, the pressure chamber substrate 72, and the nozzle plate 76 are formed of a plane plate material of, for example, silicon, and the support 75 is formed by injection molding, for example, of a resin material. The plurality of nozzles N are formed in the nozzle plate 76.

In the flow channel substrate 71, an opening section 712, a supply flow channel (restriction flow channel) 714, and a communication flow channel 716 are formed. The supply flow channel 714 and the communication flow channel 716 are through holes formed for each nozzle N, and the opening portion 712 is an opening continuous through the plurality of nozzles N. The space in which an accommodating section (recess) 752 formed in the support 75 and the opening section 712 of the flow channel substrate 71 communicate with each other functions as a common liquid chamber (reservoir) R. The common liquid chamber R stores therein ink supplied from the liquid container 14 through an introducing flow channel 754 of the support 75.

In the pressure chamber substrate 72, a pressure chamber C (cavity) is formed for each nozzle N. Each pressure chamber C is filled with ink supplied from the common liquid chamber R through the supply flow channel 714. Each pressure chamber C communicates with the nozzle N via the communication flow channel 716 of the flow channel substrate 71. The vibration section 73 is an elastic deformable flat plane material disposed on a surface of the pressure chamber substrate 72 opposite to the flow channel substrate 71.

On a surface corresponding to the pressure chamber C on a side opposite to the pressure chamber substrate 72 of the vibration section 73, a piezoelectric element 74 is formed for each nozzle N. The piezoelectric element 74 is a driving element in which a piezoelectric layer is stacked between electrodes opposite to each other, and deforms in accordance with a signal (the ejecting pulse Wa or the minute vibration pulse Wb) supplied from the driving section 251. One ejecting section 252 illustrated in FIG. 2 is a portion including the piezoelectric element 74, the vibration section 73, and a flow channel from the pressure chamber C to the nozzle N.

When the ejecting pulse Wa is supplied to the piezoelectric element 74, the pressure in the pressure chamber C varies in response to deformation of the piezoelectric element 74, and ink in the pressure chamber C passes through the communication flow channel 716 and is ejected from the nozzle N. In contrast, when the minute vibration pulse Wb is supplied to the piezoelectric element 74, the pressure in the pressure chamber C varies in response to deformation of the piezoelectric element 74; however, no ink is ejected from the nozzle N. That is, the minute vibration pulse Wb provides minute vibrations to the liquid surface within the nozzle N without causing ink to be ejected from the nozzle N. The minute vibrations agitate ink, resulting in a reduced increase in viscosity of ink in the vicinity of the nozzle N.

The liquid ejecting apparatus 100 in the first embodiment may perform an operation for adjusting the waveform of the minute vibration pulse Wb in the driving signal COM (hereinafter referred to as minute vibration adjustment) in addition to a normal printing operation by which an image represented by the image data D supplied from an external device is formed on the medium 12. The minute vibration adjustment is an operation by which the waveform of the minute vibration pulse Wb is adjusted in accordance with the characteristics of ink actually used. Upon issuance of an instruction from the user to the operating device 22, minute vibration adjustment begins.

Figure 5:
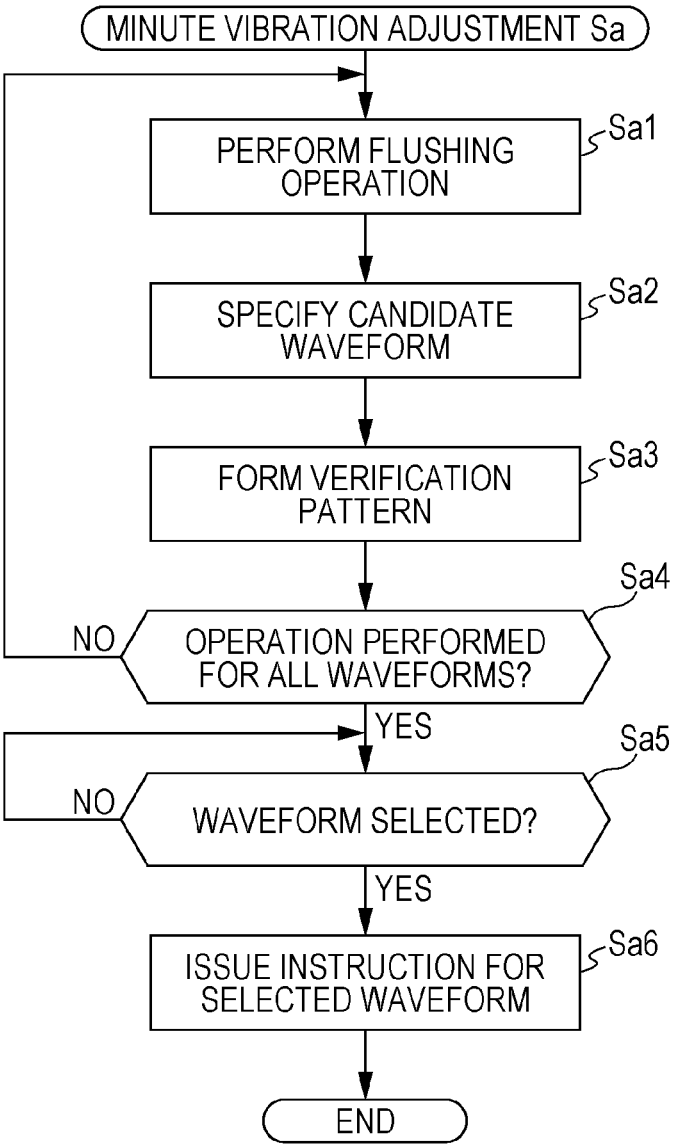
FIG. 5 is a flowchart illustrating a procedure of minute vibration adjustment.

FIG. 5 is a flowchart illustrating a procedure of minute vibration adjustment Sa. As illustrated in FIG. 5, as the minute vibration adjustment Sa begins, the control processing section 201 causes the liquid ejecting head 25 to perform a flushing operation (Sa1). The flushing operation is a maintenance operation that causes ink to be forcibly ejected from a plurality of nozzles in the situation that the liquid ejecting head 25 is at the position Ea (standby position). The flushing operation cancels an increase in viscosity of ink within the liquid ejecting head 25.

When the flushing operation (Sa1) is complete, the control processing section 201 specifies any of a plurality of waveforms that are candidates for the waveform of the minute vibration pulse Wb (hereinafter referred to as candidate waveforms) (Sa2). Specifically, as illustrated in FIG.

Figure 6:
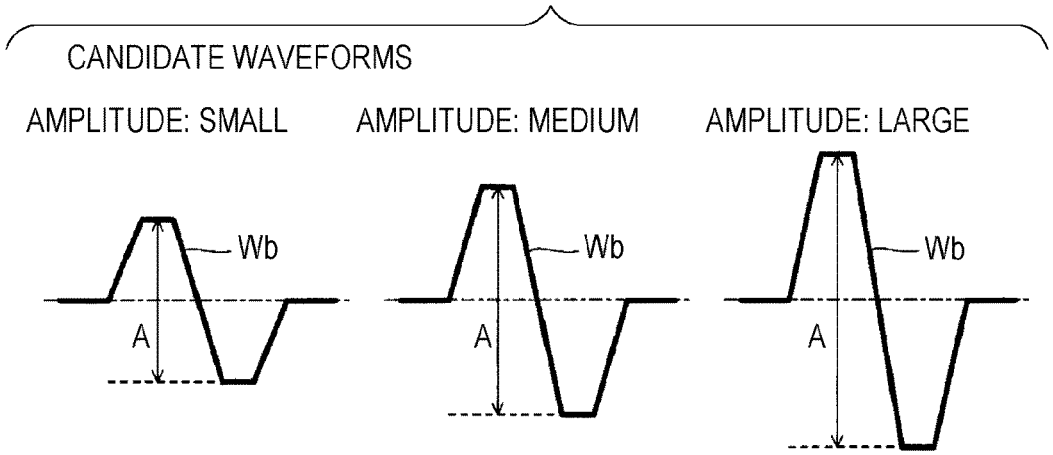
FIG. 6 includes diagrams illustrating candidate waveforms used for minute vibration adjustment.

6, any of a plurality of (three types of small, medium, and large in FIG. 6) candidate waveforms that differ in terms of the amplitude A is specified. The signal generating section 202 thus enters a state where the signal generating section 202 is able to generate the driving signal COM including the ejecting pulse Wa with a predetermined waveform and the minute vibration pulse Wb with the candidate waveform specified by the control processing section 201.

The control processing section 201 controls the driving section 251 of the liquid ejecting head 25 to cause the liquid ejecting head 25 to perform an operation of forming a specific pattern (hereinafter referred to as a verification pattern) by ink on the medium 12 (hereinafter referred to as verification pattern formation) (Sa3). The control processing section 201 in the first embodiment causes the liquid ejecting head 25 to form a verification pattern P1 (an example of a first pattern) and a verification pattern P2 (an example of a second pattern) illustrated in FIG. 7. Each of the verification pattern P1 and the verification pattern P2 is a straight-line image extending, for example, in the Y-direction (that is, a vertical ruled line). Note that although the position of the verification pattern P1 and the position of the verification pattern P2 in the X-direction ideally coincide with each other, the verification pattern P1 and the verification pattern P2 slightly differ in the position in the X-direction in FIG. 7 for the sake of convenience. Note that FIG. 7 illustrates the case where the verification pattern P1 and the verification pattern P2 differ in the position in the Y-direction.

Figure 7:
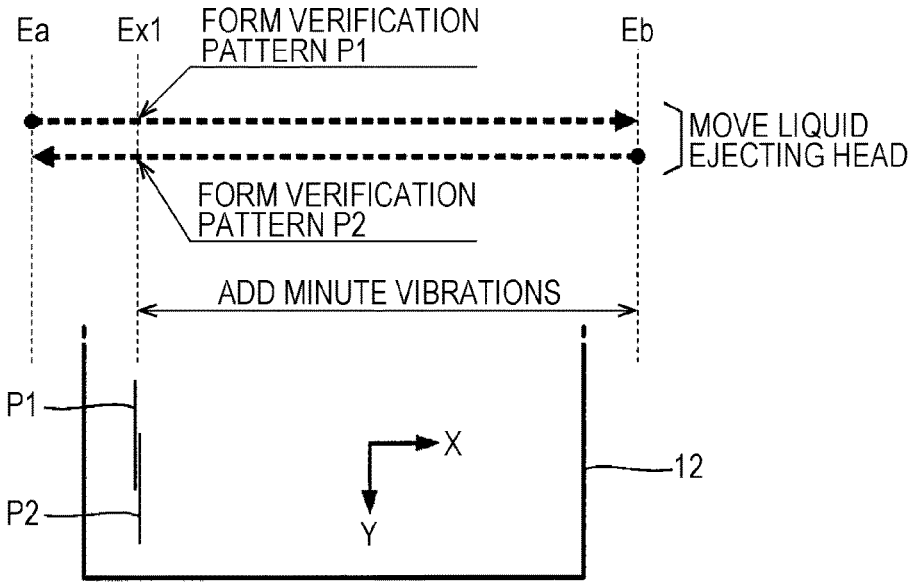
FIG. 7 is a diagram illustrating verification pattern formation in minute vibration adjustment.

Specifically, as illustrated in FIG. 7, the control processing section 201 controls the driving section 251 so that the ejecting pulse Wa is supplied to a plurality of ejecting sections 252 when the liquid ejecting head 25 is at a specific position Ex1 in a process in which the liquid ejecting head 25 moves from the position Ea on the negative side in the X-direction (standby position) to the positive side in the X-direction (an example of a first side). Supply of the ejecting pulse Wa causes ink to be ejected from the plurality of nozzles N, resulting in formation of the verification pattern P1 on the medium 12 in the process in which the liquid ejecting head 25 moves to the positive side in the X-direction. The position Ex1 is a spot close to the position Ea (standby position) in a range where the liquid electing head 25 moves (between the position Ea and the position Eb). In addition, the control processing section 201 controls the driving section 251 so that the ejecting pulse Wa is supplied to the plurality of ejecting sections 252 when the liquid ejecting head 25 is at the position Ex1 in the process in which the liquid ejecting head 25 moves from the position Eb on the positive side in the X-direction to the negative side in the X direction (an example of the second side). Supply of the ejecting pulse Wa causes ink to be ejected from the plurality of nozzles N, resulting in formation of the verification pattern P2 on the medium 12 in the process in which the liquid ejecting head 25 moves to the negative side in the X-direction.

As will be understood from the above description, the liquid ejecting head 25 forms the verification pattern P1 at the time point of arrival at the position Ex1 from the initial position Ea, and moves to the positive side in the X-direction after forming the verification pattern P1. Then, the liquid ejecting head 25 reverses the moving direction at the position Eb to move to the negative side in the X-direction, and forms the verification pattern P2 at the time point of arrival at the position Ex1 and then arrives at the initial position Ea. In the first embodiment, within a period immediately after formation of the verification pattern P1 immediately before formation of the verification pattern P2, the control processing section 201 controls the driving section 251 so that the minute vibration pulse Wb with the specified candidate waveform is supplied to the plurality of ejecting sections 252 in parallel with movement of the liquid ejecting head 25. That is, the minute vibration pulse Wb is continuously supplied to the plurality of ejecting sections 252 of the liquid ejecting head 25 until the liquid ejecting head 25 passing from the position Ex1 via the position Eb again arrives at the position Ex1.

When formation of the verification pattern P1 and the verification pattern P2 is complete, the control processing section 201 determines whether verification pattern formation has been performed for all of the candidate waveforms as illustrated in FIG. 5 (Sa4). If there is a candidate waveform for which verification pattern formation has not been performed (No in Sa4), the control processing section 201 performs the flushing operation (Sa1), specifies a candidate waveform that has not yet been specified (Sa2), and then performs verification pattern formation (Sa3). That is, verification pattern formation is repeatedly performed for each of the plurality of candidate waveforms. As will be understood from the above description, the control processing section 201 of the first embodiment controls the driving section 251 of the liquid ejecting head 25 so that, for each of the plurality of candidate waveforms, the minute vibration pulse Wb of the candidate waveform is supplied to the ejecting section 252.

If verification pattern formation has been performed for all of the candidate waveforms (Yes in Sa4), the control processing section 201 waits for a waveform to be selected by the user (Sa5). The user visually verifies a result of verification pattern formation (the verification pattern P1 and the verification pattern P2 formed on the medium 12) for each candidate waveform and selects any of the plurality of candidate waveforms in accordance with the verification result as the minute vibration pulse Wb to be used during a normal printing operation by which an image represented by the image data D is formed on the medium 12. Selection of a candidate waveform by the user will be described in more detail below.

Figure 8:
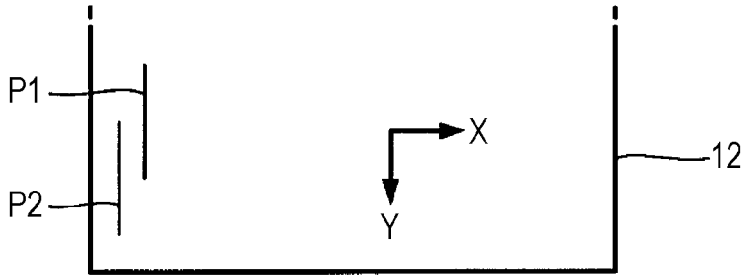
FIG. 8 is a diagram illustrating an image formed in verification pattern formation when minute vibrations are insufficient.

When non-genuine ink whose viscosity is more likely to be increased than standard ink is used, there is a possibility that an increase in viscosity of ink is unable to be sufficiently reduced by minute vibrations using the minute vibration pulse Wb of a standard candidate waveform. Since an error occurs in the ejection characteristics such as the ejection velocity and the ejection amount under the condition where the viscosity of ink is increased, an error in a position at which ink lands on the surface of the medium 12 (landing position) may occur. Accordingly, when minute vibrations are insufficient for ink actually used in the liquid ejecting head 25, the position of the verification pattern P1 and the position of the verification pattern P2 in the X-direction differ as illustrated in FIG. 8. That is, the verification pattern P1 and the verification pattern P2 separate from each other are formed at intervals in the X-direction.

Figure 9:
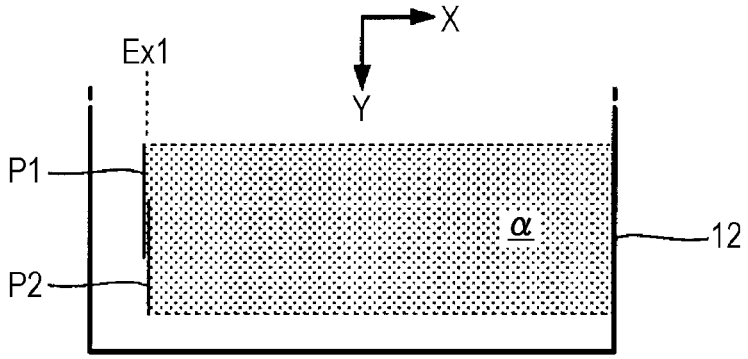
FIG. 9 is a diagram illustrating an image formed in verification pattern formation when minute vibrations are excessively large.

In addition, when non-genuine ink having a lower viscosity than standard ink is used, there is a possibility that ink is ejected (ejection error) from the nozzle N by minute vibrations using the minute vibration pulse Wb of a standard candidate waveform. That is, as illustrated in FIG. 9, ink may adhere to the medium 12 within a range $\alpha$ from the position Ex1 to the side of the position Eb (within an area where ink is not to adhere if the intensity of minute vibrations is suitable).

As illustrated above, when the intensity of minute vibrations is insufficient for ink used in the liquid ejecting head 25, the verification pattern P1 and the verification pattern P2 do not coincide with each other in terms of the position in the X-direction. Accordingly, visually verifying that the verification pattern P1 and the verification pattern P2 are separate from each other allows the user to determine that a candidate waveform is not suitable (the intensity of minute variations is insufficient) for the ink being used. Otherwise, if the intensity of minute vibrations is excessively large for ink, the ink adheres within the range α. Accordingly, visually verifying that ink adheres within the range a allows the user to determine that a candidate waveform is not suitable (the intensity of minute vibrations is excessively large) for the ink being used. With the circumstances described above as a background, the user selects a candidate waveform with which the positions in the X-direction of the verification pattern P1 and the verification pattern P2 coincide with each other and with which no ink adheres within the range α as a suitable waveform of the minute vibration pulse Wb for the ink being used.

Figure 10:
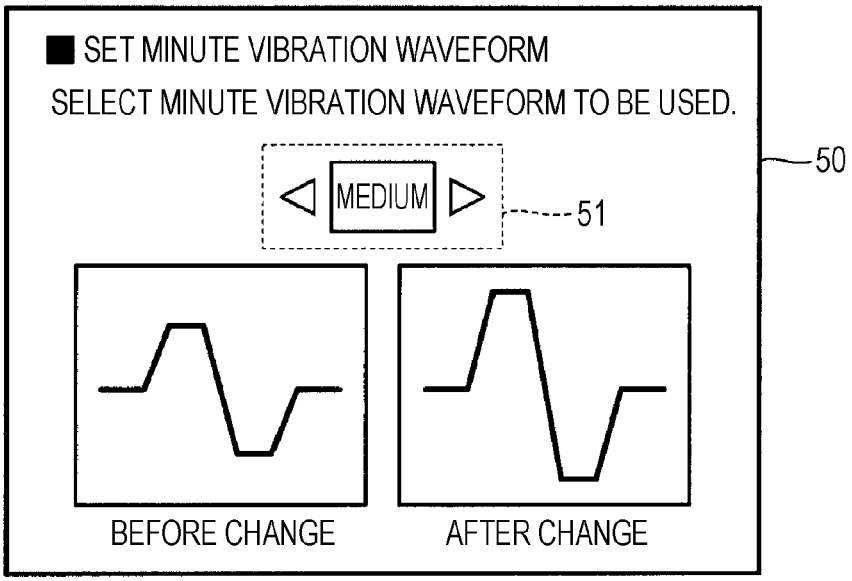
FIG. 10 is a schematic diagram of a waveform setting screen.

Specifically, the control processing section 201 causes the display device 21 to display an image (hereinafter referred to as a waveform setting screen) 50 in FIG. 10. The waveform setting screen 50 is a graphical user interface (GUI) for the user to select the waveform of the minute vibration pulse Wb. Appropriately operating an operation section 51 of the waveform setting screen 50 by using the operating device 22 allows the user to select any of a plurality of candidate waveforms as a waveform of the minute vibration pulse Wb. On the waveform setting screen 50 illustrated in FIG. 10, the current waveform of the minute vibration pulse Wb (waveform before change) and a candidate waveform selected by an operation of the user for the operation section 51 (waveform after change) are comparably displayed.

If the user selects a candidate waveform (Yes in Sa5), the control processing section 201 instructs the signal generating section 202 to use the candidate waveform selected by the user (Sa6). The signal generating section 202 generates the driving signal COM including the minute vibration pulse Wb of the candidate waveform for which the instruction has been issued by the control processing section 201. That is, the control processing section 201 sets the waveform of the minute vibration pulse Wb of the driving signal COM in accordance with an instruction from the user.

As described above, in the first embodiment, for each of a plurality of candidate waveforms, the minute vibration pulse Wb of the candidate waveform is supplied to each ejecting section 252, and then a waveform of the minute vibration pulse Wb included in the driving signal COM is set in accordance with an instruction from the user. Accordingly, the waveform of the minute vibration pulse Wb may be suitably set in accordance with the characteristics of ink used for the liquid ejecting apparatus 100. Specifically, an error in the landing position that occurs when ink whose viscosity is likely to be increased is used or an ejection error of ink that occurs when ink with a low viscosity is used is effectively suppressed by the first embodiment.

Second Embodiment

A second embodiment of the invention will be described. Note that, for components in each embodiment illustrated below having actions or functions similar to those in the first embodiment, reference numerals used in the description of the first embodiment are used and detailed description of each of the elements is omitted as appropriate.

In the first embodiment, in the verification pattern formation (Sa3), the minute vibration pulse Wb of a candidate waveform is supplied to the ejecting section 252 when the liquid ejecting head 25 moves from the position Ea to the position Eb and from the position Eb to the position Ea, and the ejecting pulse Wa is supplied to the ejecting section 252 at the specific position Ex1 closer to the position Ea than to the position Eb between the position Ea and the position Eb, thereby forming the verification pattern P1 and the verification pattern P2 on the medium 12. In the second embodiment, the minute vibration pulse Wb of a candidate waveform is supplied to the ejecting section 252 when the liquid ejecting head 25 moves from the position Ea to the position Eb, and the ejecting pulse Wa is supplied to the ejecting section 252 at the position Ex2 closer to the position Eb than to the position Ea between the position Ea and the position Eb, thereby forming a verification pattern P, while neither ejecting pulse Wa nor minute vibration pulse Wb is supplied to the ejecting section 252 when the liquid ejecting head 25 moves from the position Eb to the position Ea. In addition, in the second embodiment, the amplitude A of the candidate waveform of the minute vibration pulse Wb increases stage by stage, and the user checks whether there is an ejection error for each stage. Specifically, the control processing section 201 increases the amplitude A of a candidate waveform in step Sa4 each time step Sa2 and step Sa3 in FIG. 5 are executed. For example, assuming that a predetermined value of the amplitude A is a reference (100%), the amplitude A of a candidate waveform is changed in stages each time step Sa2 and step Sa3 are executed in the order in which the amplitude A is from 10% to 25% to 50% to 75% to 100%. Note that the candidate waveforms for which the amplitude A is increased in stages are not limited to those set in advance and may be set in accordance with an instruction from the user. For example, when the user inputs a stage number of the amplitude A, the control processing section 201 sets a candidate waveform in accordance with the input stage number within a range of 0 to 100% of the reference value of the amplitude A. Alternatively, for example, the user directly inputs the ratios of a plurality of stages relative to the reference value of the amplitude A for candidate waveforms (for example, inputting "25%", "90%", and "50%"), and the control processing section 201 sorts the input ratios in ascending order (for example, "from 25% to 50% to 90%") to set candidate waveforms.

Figure 11:
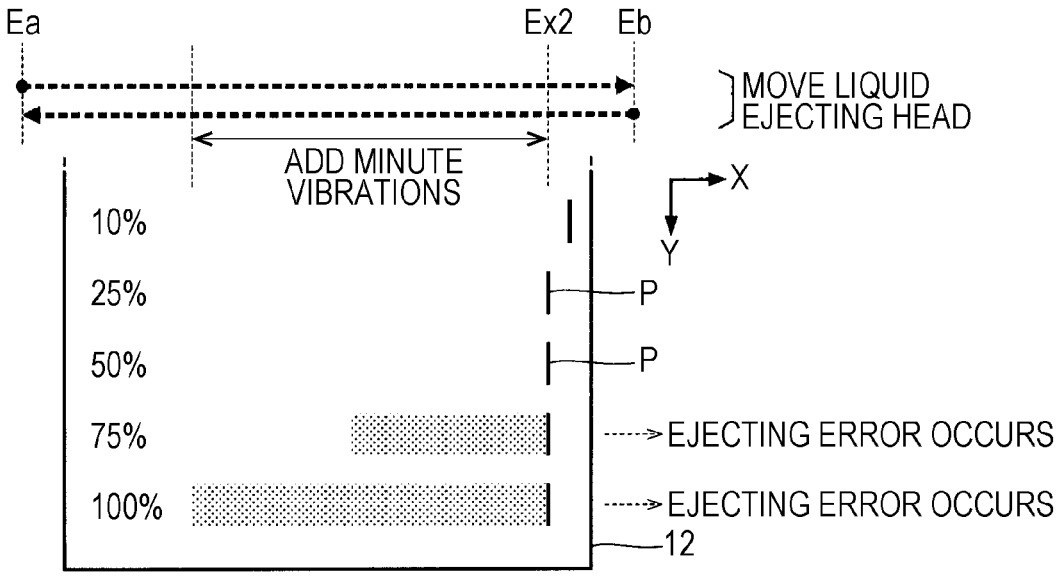
FIG. 11 is a diagram illustrating an image formed in verification pattern formation in a second embodiment.

In verification pattern formation (Sa3), as illustrated in FIG. 11, in each of processes in which the liquid ejecting head 25 moves to the positive side and the negative side in the X-direction, the control processing section 201 controls the driving section 251 so that the minute vibration pulse Wb of a candidate waveform to be processed is supplied to a plurality of ejecting sections 252. That is, in parallel with the movement of the liquid ejecting head 25, the minute vibration pulse Wb of the candidate waveform in question is supplied to a plurality of ejecting sections 252. In addition, the control processing section 201 controls the driving section 251 so that the ejecting pulse Wa is supplied to a plurality of ejecting sections 252 at a time point at which the liquid ejecting head 25 is at a position Ex2. The position Ex2 is a spot near the position Eb (standby position) within the range where the liquid ejecting head 25 moves (between the position Ea and the position Eb). Supply of the ejecting pulse Wa causes ink to be ejected from a plurality of nozzles N, resulting in formation of the verification pattern P on the medium 12. If verification pattern formation has been performed for each of a plurality of candidate waveforms that differ in the amplitude A (Yes in Sa4), the control processing section 201 waits for selection of a candidate waveform by the user (Sa5).

As the amplitude A of the minute vibration pulse Wb (candidate waveform) is increased in stages, an ejection error of ink caused by minute vibrations starts to occur at a stage where the amplitude A exceeds a limit in accordance with the characteristics of the ink being used. The user selects the candidate waveform with the amplitude A at a stage where an ejection error has not occurred, as a waveform of the minute vibration pulse Wb suitable for the ink being used. For example, in the example in FIG. 11, no ejection error occurs at stages where the amplitude A is less than or equal to 50% of the reference value while ejection errors occur at stages where the amplitude A is set to be greater than or equal to 75% (75%, 100%) of the reference value. Accordingly, the user selects a candidate waveform with the amplitude A of 50% of the reference value, as a waveform of the minute vibration pulse Wb. In addition, in the example in FIG. 11, the verification pattern P at a stage where the amplitude A is 10% of the reference value is displaced from the verification patterns P at stages where the amplitude A is greater than or equal to 25% of the reference value. This indicates that the intensity of minute vibrations is insufficient in the minute vibration pulse Wb of a candidate waveform at the stage where the amplitude A is 10% of the reference value. Accordingly, the user can select a candidate waveform with the amplitude A that is 25% or 50% of the reference value, as the waveform of the minute vibration pulse Wb.

Figure 12:
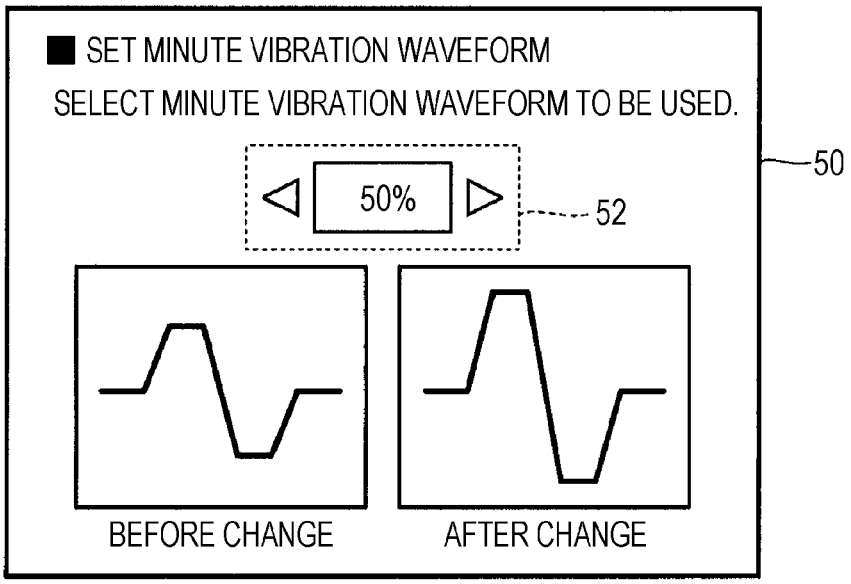
FIG. 12 is a schematic diagram of a waveform setting screen in the second embodiment.

FIG. 12 is a display example of the waveform setting screen 50 in the second embodiment. As illustrated in FIG. 12, the waveform setting screen 50 in the second embodiment includes an operating section 52 for selecting the amplitude A for a candidate waveform. That is, operating the operating section 52 of the waveform setting screen 50 by using the operating device 22 as appropriate allows the user to select the amplitude A with which no ejection error caused by minute vibrations is estimated to occur. The second embodiment is similar to the first embodiment in that the waveforms of the minute vibration pulse Wb before and after being changed are displayed in comparison with each other.

If the user selects a candidate waveform (the amplitude A) (Yes in Sa5), the control processing section 201 instructs the signal generating section 202 to use the candidate waveform selected by the user (Sa6). The signal generating section 202 generates the driving signal COM including the minute vibration pulse Wb of the waveform for which the instruction has been given by the control processing section 201. That is, the control processing section 201 in the second embodiment, as in the first embodiment, sets a waveform of the minute vibration pulse Wb of the driving signal COM in accordance with the instruction from the user.

In the second embodiment, as in the first embodiment, for each of a plurality of candidate waveforms, the minute vibration pulse Wb of the candidate waveform is supplied to each ejecting section 252, and then the waveform of the minute vibration pulse Wb included in the driving signal COM is set in accordance with an instruction from the user. Accordingly, it is possible to suitably set the waveform of the minute vibration pulse Wb in accordance with the characteristics of ink used for the liquid ejecting apparatus 100. Specifically, it is possible to effectively suppress an ejection error of ink that may occur resulting from minute vibrations when ink having a low viscosity is used.

Note that when the user has issued an instruction of the amplitude A with which an ejection error caused by minute vibrations starts to occur (the amplitude A used as a boundary between the presence and absence of an ejection error), the control processing section 201 may automatically set an amplitude value below the amplitude A in question as the amplitude A of the minute vibration pulse Wb. For example, an amplitude value that is below the amplitude A with which an ejection error starts to occur, by a predetermined margin, is set as the amplitude A after change in the minute vibration pulse Wb.

Third Embodiment

In the first embodiment, the user determines whether an error in the landing position is present or absent, depending on whether the positions in the X-direction coincide with each other between the verification pattern P1 and the verification pattern P2. However, in reality, there is a possibility that the positions in the X-direction do not coincide with each other between the verification pattern P1 and the verification pattern P2 for a reason other than minute vibrations (for example, a mechanical error). In view of the above circumstances, in a third embodiment, an operation of reducing a position error (i.e., a difference) between the verification pattern P1 and the verification pattern P2 for a reason other than minute vibrations (hereinafter referred to as an initial operation) is performed before start of the minute vibration adjustment Sa (Sa1 to Sa6).

Figure 13:
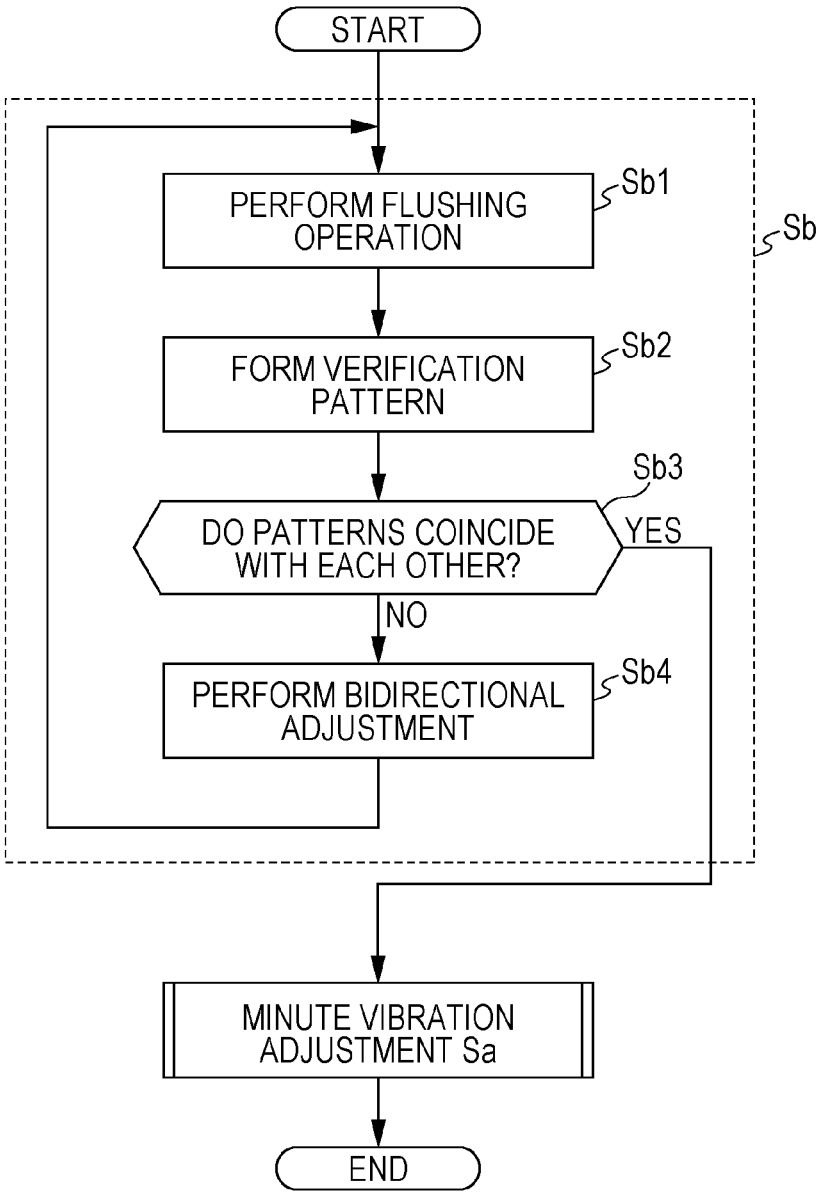
FIG. 13 is a flowchart of operations in a third embodiment.

FIG. 13 is a flowchart of an initial operation Sb and the minute vibration adjustment Sa in the third embodiment. As the initial operation Sb begins, the control processing section 201 causes the liquid ejecting head 25 to perform a flushing operation (Sb1). Then, as in the verification pattern formation in the first embodiment, the control processing section 201 controls the driving section 251 so that the liquid ejecting head 25 forms the verification pattern P1 and the verification pattern P2 (Sb2). Specifically, when the liquid ejecting head 25 is at the position Ex1 in the process of moving from the position Ea (standby position) on the negative side in the X-direction to the positive side in the X-direction, the ejecting pulse Wa is supplied to each ejecting section 252 to form the verification pattern P1. In addition, when the liquid ejecting head 25 is at the position Ex1 in the process of moving to the negative side in the X-direction, the ejecting pulse Wa is similarly supplied to each ejecting section 252 to form the verification pattern P2.

Note that, in the verification pattern formation in the first embodiment, the liquid ejecting head 25 is moved from the position Ea to the position Eb in order to ensure a sufficient period during which the minute vibration pulse Wb is given. In the initial operation Sb, an object thereof is to detect a factor other than suitability of the minute vibration pulse Wb that influences the landing position of liquid, for example, a mechanical error, and the influence caused by the minute vibration pulse Wb needs to be removed. That is, in the formation of the verification pattern P1 and the verification pattern P2 in the initial operation Sb, it is preferable that, after performing ejection in order to form the verification pattern P1 at the position Ex1, the liquid ejecting head 25 reverses its direction at a stage at which the liquid ejecting head 25 arrives at a predetermined position in front of the position Eb (closer to the position Ea than the position Eb).

The user visually checks an image formed on the medium 12 in step Sb2 to determine whether the position of the verification pattern P1 and the position of the verification pattern P2 in the X-direction differ from each other. In addition, the user issues an instruction about a result of verification to the liquid ejecting apparatus 100 by using the operating device 22. In accordance with the instruction from the user, the control processing section 201 determines whether the positions coincide with each other between the verification pattern P1 and the verification pattern P2 (Sb3). If the verification pattern P1 and the verification pattern P2 differ in position (No in Sb3), the control processing section 201 performs bidirectional adjustment (Sb4), and then the process proceeds to step Sb1. The bidirectional adjustment is a process for reducing a difference in the landing position of ink between the process in which the liquid ejecting head 25 moves to the positive side in the X-direction and the process in which the liquid ejecting head 25 moves to the negative side. Known techniques may be optionally employed for the bidirectional adjustment. The bidirectional adjustment is repeatedly performed until the positions in the X-direction of the verification pattern P1 and the verification pattern P2 become to coincide with each other. Otherwise, if the positions of the verification pattern P1 and the verification pattern P2 coincide with each other (No in Sb3), the control processing section 201 starts the minute vibration adjustment Sa, which is similar to that in each embodiment described above.

In the third embodiment, advantages similar to those in the first embodiment are achieved. In addition, in the third embodiment, the initial operation before start of the minute vibration adjustment Sa reduces a position error between the verification pattern P1 and the verification pattern P2 caused by a factor other than suitability of the minute vibration pulse Wb. Accordingly, in the minute vibration adjustment Sa, it is possible to set the waveform of the minute vibration pulse Wb so as to effectively reduce an error in the landing position caused by minute vibrations.

Modifications

Each embodiment illustrated above may be modified in various manners. Specific forms of modifications that may be applied to each embodiment described above will be illustrated below. Any two or more forms selected from the illustration given below may be merged as appropriate as long as they are not inconsistent with each other.

(1) In the first embodiment and the third embodiment, the case where the user selects any of a plurality of candidate waveforms of the minute vibration pulse Wb set in advance is illustrated. In the second embodiment, the case where the user sets the amplitude A of a candidate waveform of the minute vibration pulse Wb for a plurality of stages and selects any of the candidate waveforms as the minute vibration pulse Wb is illustrated. The method for setting the waveform of the minute vibration pulse Wb in accordance with an instruction from the user is not limited to the illustration given above.

Figure 14:
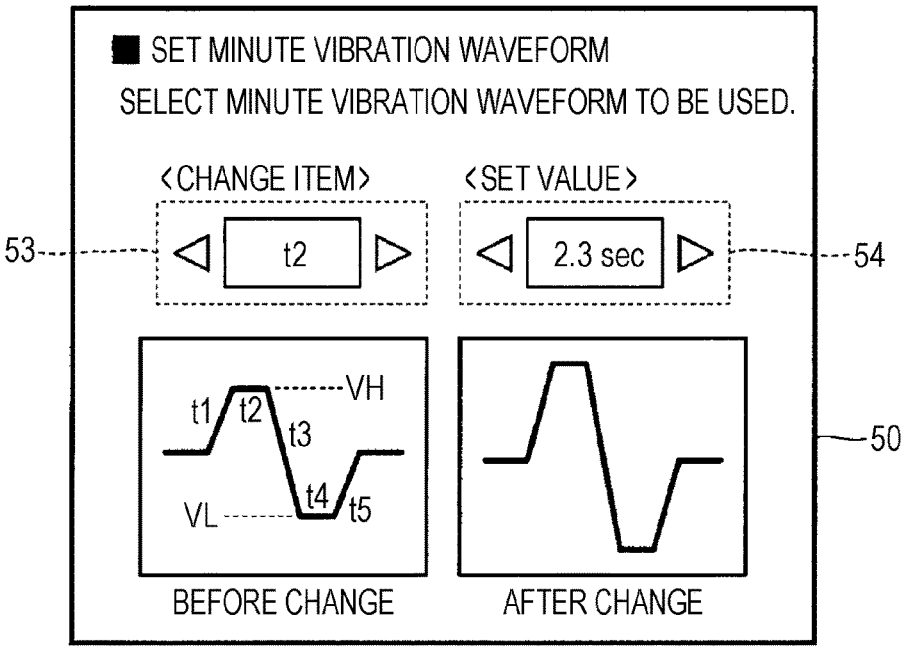
FIG. 14 is a schematic diagram of a waveform setting screen in a modification.

For example, by using the waveform setting screen 50 illustrated in FIG. 14, the amplitude A (the voltage VH and the voltage VL) and a duration t (t1 to t5) in each interval Q of the minute vibration pulse Wb may be set in accordance with an instruction from the user. The waveform setting screen 50 in FIG. 14 is configured to include an operating section 53 and an operating section 54. The user appropriately operates the operating section 53 by using the operating device 22 to be able to select a change item regarding the minute vibration pulse Wb. Specifically, the user may select either of the duration t (t1 to t5) in each interval Q and the amplitude A (VH and VL) by an operation for the operating section 53. In addition, the user appropriately operates the operating section 54 by using the operating device 22 to be able to change the numerical value of a change item selected with the operating section 53. For example, FIG. 14 illustrates a state in which the user has selected the duration t2 of the interval Q2 as a change item by an operation for the operating section 53. Accordingly, the user operates the operating section 54 to be able to change the duration t2 of the interval Q2 in the minute vibration pulse Wb. According to the configuration described above, there is an advantage in that it is possible to adjust the waveform of the minute vibration pulse Wb in detail. Note that only either of the amplitude A and the duration t (t1 to t5) in each interval Q in the minute vibration pulse Wb may be set in accordance with an instruction from the user.

Note that the user may change at least either of the amplitude A and the duration t (t1 to t5) in each interval Q of the minute vibration pulse Wb by using the operating section 53 to specify a candidate waveform in step Sa2, form a verification pattern of the candidate waveform in question in step Sa3, and then, if the candidate waveform in question is suitable, select the candidate waveform in question for the minute vibration pulse Wb used in the normal printing operation, in which an image represented by the image data D is formed on the medium 12. If the candidate waveform in question is not suitable, it is also possible to repeat the flushing operation and step Sa2 and step Sa3 described above until a suitable candidate waveform is verified.

(2) Although, in each of the above embodiments, the case where the user changes the waveform of the minute vibration pulse Wb while checking the waveforms before and after change by using a displayed image is illustrated, the display of waveforms of the minute vibration pulse Wb may be omitted. For example, a configuration in which any of "large", "medium", and "small" is displayed as the intensity of minute vibrations on the display device 21 to allow the user to select it or a configuration in which the user specifies the amplitude A of the minute vibration pulse Wb as a voltage value may be employed.

(3) Although, in each of the above embodiments, the case where the waveform of the minute vibration pulse Wb is set in accordance with an instruction from the user is illustrated, the number of minute vibration pulses Wb included in one period of the driving signal COM (that is, the frequency of minute vibrations), in addition to the waveform of the minute vibration pulse Wb, may be changed in accordance with an instruction from the user. For example, the user selects any of a plurality of candidate values (for example, one to five values) for the minute vibration pulse Wb by using the operating device 22. The signal generating section 202 generates the driving signal COM including a user-set number of minute vibration pulses Wb in each period. According to the configuration described above, it is possible to supply the minute vibration pulse Wb to the ejecting section 252 at a frequency at which it is possible to sufficiently reduce an increase in viscosity while suppressing an ejection error caused by minute vibrations.

(4) In each of the above embodiments, the user visually verifies a result of verification pattern formation. In another embodiment, by reference to a result obtained by imaging the medium 12 by using an imaging device, the control processing section 201 may determine whether there is an error in the landing position caused by a shortage in strength of minute vibrations or whether there is an ejection error caused by excessive minute vibrations.

For example, in the first embodiment or in the third embodiment, the control processing section 201 may set a candidate waveform with which the difference (i.e., a gap)

between the verification pattern P1 and the verification pattern P2 is within a predetermined threshold value and with which an ejection error is not detected, as the minute vibration pulse Wb used during a normal printing operation in which an image represented by the image data D is formed on the medium 12. In addition, in the second embodiment, the control processing section 201 may set a candidate waveform with which an ejection error is not detected and with which the amount of displacement from the verification pattern P at a stage adjacent to a stage at which an ejection error occurs falls within a predetermined threshold value, as the minute vibration pulse Wb used during a normal printing operation in which an image represented by the image data D is formed on the medium 12.

Figure 15:
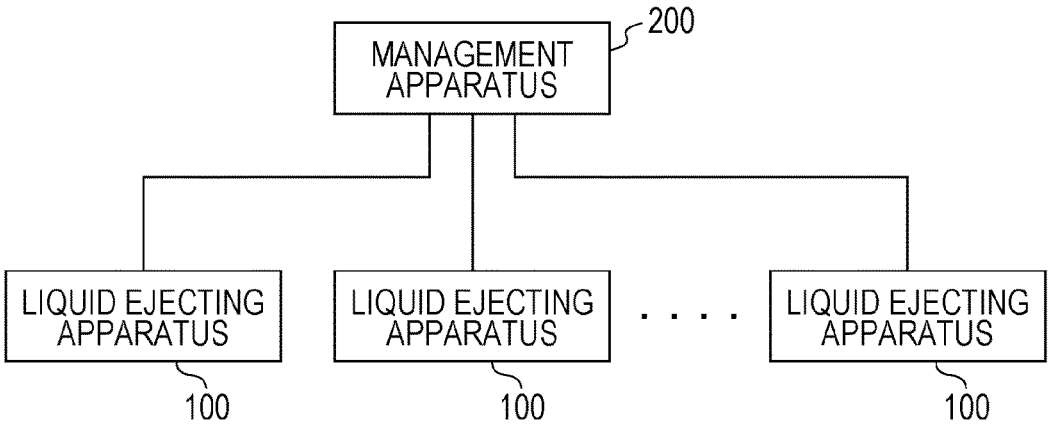
FIG. 15 is a configuration diagram for a printing system in the modification.

(5) FIG. 15 is a configuration diagram for a printing system according to a modification. A printing system in FIG. 15 includes a management apparatus 200 and a plurality of liquid ejecting apparatuses 100. The configuration of each of the plurality of liquid ejecting apparatuses 100 is similar to that in each embodiment described above. The management apparatus 200 includes an information processing apparatus such as a personal computer and performs overall control of operations of the plurality of liquid ejecting apparatuses 100. Specifically, the management apparatus 200 performs the minute vibration adjustment Sa similar to that in each embodiment described above to set the waveform of the minute vibration pulse Wb in accordance with an instruction of the user. An instruction of the waveform set by the management apparatus 200 is given to each of the plurality of liquid ejecting apparatuses 100. The signal generating section 202 of each liquid ejecting apparatus 100 generates the driving signal COM including the minute vibration pulse Wb of a waveform of which an instruction has been given by the management apparatus 200. Note that although adjustment of a waveform of the minute vibration pulse Wb has been illustrated, the management apparatus 200 may set the number of minute vibration pulses Wb in each period of the driving signal COM in accordance with an instruction from the user and give an instruction of the number to each liquid ejecting apparatus 100.

(6) A component (driving element) that gives pressure to the inside of the pressure chamber C is not limited to the piezoelectric element 74 illustrated in each of the above embodiments. For example, a heat generating element that produces air bubbles inside the pressure chamber C by heating may be used as a driving element. As will be understood from the above illustration, the driving element is comprehensively represented as a component for ejecting liquid (typically a component that gives pressure to the inside of the pressure chamber C), and there is no limit to its operating method (piezoelectric method or heating method) and to its specific configuration.

The entire disclosure of Japanese Patent Application No. 2017-041482, filed Mar. 6, 2017 is expressly incorporated by reference herein.

What is claimed is:

1. A method for controlling a liquid ejecting apparatus including a liquid ejecting head including an ejecting section that ejects liquid from a nozzle, a movement mechanism configured to move the liquid ejecting head, a signal generating section configured to generate a driving signal, the driving signal including ejecting pulses that cause liquid to be ejected from the nozzle and minute vibration pulses that vibrate a liquid surface within the nozzle without causing liquid to be ejected from the nozzle, a driving section configured to drive the ejecting section by using the driving signal, and an operating device configured to accept an instruction of a waveform of the minute vibration pulses, the method comprising:

driving the ejecting section by using each of a plurality of candidate waveforms of the minute vibration pulses in parallel with movement of the liquid ejecting head, the candidate waveforms are different from each other; and setting a waveform of the minute vibration pulses included in a driving signal generated by the signal generating section, in accordance with the instruction accepted with the operating device.

2. The method according to claim 1, wherein, in the setting of the waveform of the minute vibration pulses, one of the plurality of the candidate waveforms is set as the waveform of the minute vibration pulses in accordance with the instruction accepted with the operating device.

3. The method according to claim 1, wherein the minute vibration pulses each include a plurality of intervals with different states of voltage change, and wherein, in the setting of the waveform of the minute vibration pulses, at least either of an amplitude of the minute vibration pulses and a duration of each of the intervals is set in accordance with the instruction accepted with the operating device.

4. The method according to claim 1, wherein, in the setting of the waveform of the minute vibration pulses, a waveform and the number of the minute vibration pulses included in one period of a driving signal generated by the signal generating section are set in accordance with the instruction accepted with the operating device.

5. The method according to claim 1, wherein the movement mechanism is configured to shuttle the liquid ejecting head between a first side and a second side, wherein, the method comprising:

in the driving of the ejecting section by using each of the plurality of candidate waveforms, driving the ejecting section by using the ejecting pulses so as to form a first pattern when the liquid ejecting head is at a specific position in a process of moving to the first side from the second side, driving the ejecting section by using the ejecting pulses so as to form a second pattern when the liquid ejecting head is at the specific position in a process of moving to the second side from the first side, and driving the ejecting section by using one of the plurality of candidate waveforms in parallel with movement of the liquid ejecting head between forming the first pattern and forming the second pattern.

6. The method according to claim 5, the method further comprising:

prior to forming the first pattern and the second pattern, performing a bidirectional adjustment for reducing a difference between a landing position of liquid in a process in which the liquid ejecting head moves to the first side from the second side and a landing position of liquid in a process in which the liquid ejecting head moves to the second side from the first side.

7. A method for controlling a liquid ejecting apparatus including a liquid ejecting head including an ejecting section that ejects liquid from a nozzle, a movement mechanism configured to move the liquid ejecting head, a signal generating section configured to generate a driving signal, the driving signal including ejecting pulses that cause liquid to be ejected from the nozzle and minute vibration pulses that vibrate a liquid surface within the nozzle without causing liquid to be ejected from the nozzle, and a driving section configured to drive the ejecting section by using the driving signal, the method comprising:

driving the ejecting section by using each of a plurality of candidate waveforms of the minute vibration pulses in parallel with movement of the liquid ejecting head, the candidate waveforms are different from each other; and setting one of the plurality of candidate waveforms as a waveform of the minute vibration pulses included in a driving signal generated by the signal generating section, the candidate waveform set as the waveform of the minute vibration pulses is the candidate waveform that has not caused an ejection error when the ejecting section has been driven by using each of the plurality of candidate waveforms.

8. The method according to claim 7, wherein the movement mechanism is configured to shuttle the liquid ejecting head between a first side and a second side, wherein, the method comprising:

in the driving of the ejecting section by using each of the plurality of candidate waveforms, driving the ejecting section by using ejecting pulses so as to form a first pattern when the liquid ejecting head is at a specific position in a process of moving to the first side from the second side, driving the ejecting section by using the ejecting pulses so as to form a second pattern when the liquid ejecting head is at the specific position in a process of moving to the second side from the first side, and driving the ejecting section by using one of the plurality of candidate waveforms in parallel with movement of the liquid ejecting head between forming the first pattern and forming the second pattern.

9. The method according to claim 8, wherein the candidate waveform set as the waveform of the minute vibration pulses, is the candidate waveform with which a difference between the first pattern and the second pattern falls within a threshold value.

10. The method according to claim 8, the method further comprising:

prior to forming the first pattern and the second pattern, performing a bidirectional adjustment for reducing a difference between a landing position of liquid in a process in which the liquid ejecting head moves to the first side from the second side and a landing position of liquid in a process in which the liquid ejecting head moves to the second side from the first side.

11. A liquid ejecting apparatus comprising:

a liquid ejecting head including an ejecting section that ejects liquid from a nozzle;

a movement mechanism configured to move the liquid ejecting head;

a signal generating section configured to generate a driving signal, the driving signal including ejecting pulses that cause liquid to be ejected from the nozzle and minute vibration pulses that vibrate a liquid surface within the nozzle without causing liquid to be ejected from the nozzle;

a driving section configured to drive the ejecting section by using the driving signal;

an operating device configured to accept an instruction of a waveform of the minute vibration pulses; and a control processing section configured to control the driving section and the movement mechanism so as to drive the ejecting section by using each of a plurality of candidate waveforms of the minute vibration pulses in parallel with movement of the liquid ejecting head, the candidate waveforms are different from each other, and set a waveform of the minute vibration pulses included in a driving signal generated by the signal generating section, in accordance with the instruction accepted with the operating device.

* * * * *